United States Patent [19]

Williams et al.

[11] Patent Number: 4,583,694

[45] Date of Patent: Apr. 22, 1986

[54] SPRAY NOZZLE AND REMOVAL TOOL

[75] Inventors: Edward A. Williams; Donald R. Hastings, both of Elyria, Ohio

[73] Assignee: Nordson Corporation, Amherst, Ohio

[21] Appl. No.: 618,465

[22] Filed: Jun. 8, 1984

[51] Int. Cl.[4] ..... B05B 5/00

[52] U.S. Cl. ..... 239/690; 81/121.1; 239/289; 239/390; 239/600; 239/707

[58] Field of Search ..... 239/289, 542, 600, 690, 239/390, 707; 81/121.1

[56] References Cited

U.S. PATENT DOCUMENTS 3,121,355 2/1964 Morel et al. ..... 81/121.1

3,815,831 6/1974 Jooste ..... 239/542

3,874,258 4/1975 Semola et al. ..... 81/121.1

*Primary Examiner*—Jeffrey V. Nase

*Attorney, Agent, or Firm*—Oldham, Oldham & Weber Co.

[57] ABSTRACT

A tool for removing the nozzle assembly of a coating spray gun. The tool has an inner wall surface of a configuration congruent with an outer surface of the spray assembly. The inner wall thereof defines a cavity which is closed at one end thereof such that the tool, when placed over the nozzle assembly, encloses the nozzle and protects the user from spray injection. Preferably, the outer surface of the tool is knurled to facilitate use.

12 Claims, 8 Drawing Figures

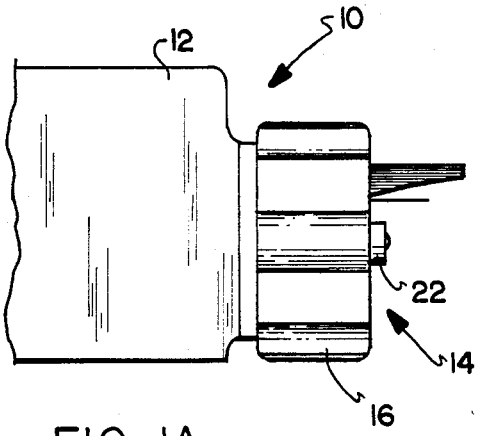
FIG. 1A
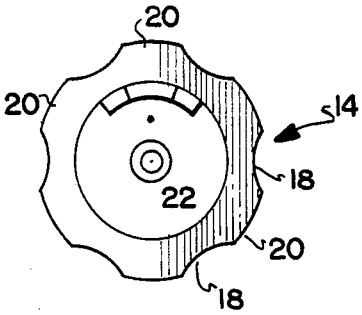
FIG. 1B
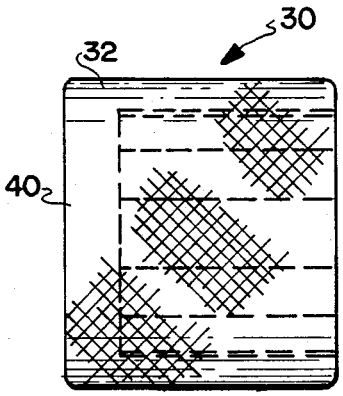
FIG. 2A
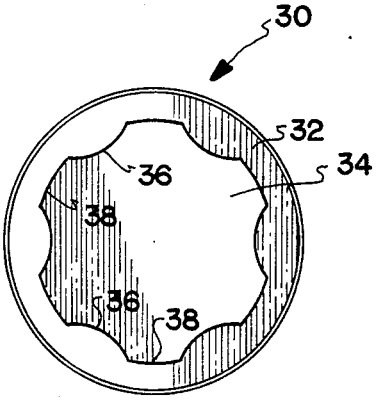
FIG. 2B
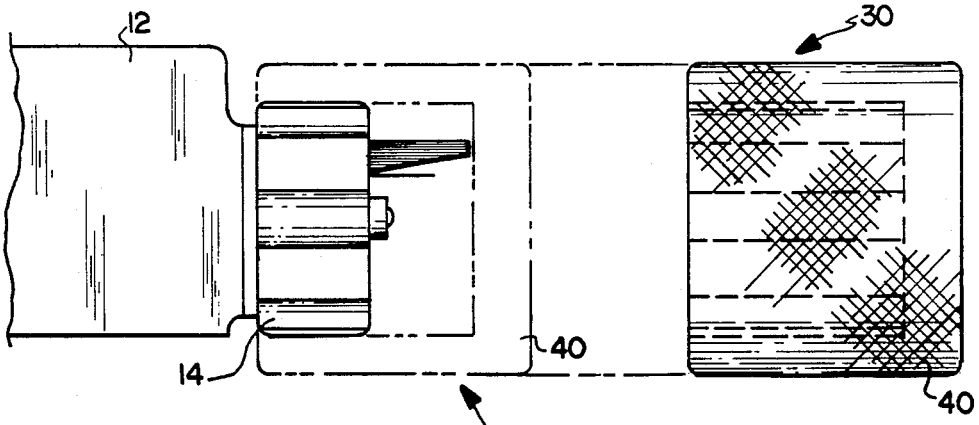
FIG. 3A
FIG. 3B

SPRAY NOZZLE AND REMOVAL TOOL

TECHNICAL FIELD

The invention herein resides in the art of spray coating apparatus. The invention relates particularly to a tool which facilitates the application and removal of a spraying nozzle to a spray gun.

BACKGROUND ART

Heretofore it has been known that the nozzles used for coating spray guns differ with respect to the coating to be applied by the gun. Particularly, the spray nozzle is tailored to a specific viscosity or molecular structure of the coating to be sprayed. This is true in the case of hand held spray guns as well as the automatic guns used in continuous coaters.

Since the characteristics of the spray nozzles are dependent upon the coating being sprayed, the spray guns require the capability of changing spray nozzles such that a single gun may be used to spray various types of coatings. Such spray guns atomize the coating material, and emit the coating from the nozzle at a sufficient force and particle size that the spray is capable of penetrating the flesh of a human being, thereby injecting coating material into the person's body. Accordingly, it is mandatory that great care be taken when changing the spray nozzle, particulary since such nozzles are generally changed by hand. Hence, there is a need in the art for a nozzle changing tool which encloses the spraying nozzle, preventing communication between the nozzle and an operator.

DISCLOSURE OF THE INVENTION

In light of the foregoing, a first aspect of the invention is the provision of the combination of a spray nozzle and removal tool wherein the tool covers the nozzle to isolate the same from the user or operator.

An additional aspect of the invention is the provision of the combination of a spray nozzle and removal tool wherein the tool contacts a plurality of points on the nozzle and is externally knurled for accommodating force application by the operator.

Yet a further aspect of the invention is the provision of the combination of a spray nozzle and removal tool which includes means for locating and aligning the electrode of the spray nozzle as the retaining ring is secured.

Still an additional aspect of the invention is the provision of the combination of a spray nozzle and removal tool which is uncomplicated in design and construction, reliable in operation, and readily adapted for implementation with state of the art spray coating guns.

The foregoing and other aspects of the invention which will become more apparent as the detailed description proceeds are achieved by the combination of a spray nozzle assembly and a tool for applying and removing the nozzle from the spray gun, comprising: a spray nozzle shell; and a tool having an opening therein congruent with said shell, said opening being closed at one end thereof to define a cavity. Other aspects of the invention are achieved by a tool for removing and replacing a spray nozzle for a spray coating gun, comprising: a casing; and a cavity within said casing defined by an inner wall surface; said inner wall surface being of a configuration to receive, in selected alignment, an outer surface of the spray nozzle.

BRIEF DESCRIPTION OF THE DRAWINGS

For a complete understanding of the objects, techniques, and structure of the invention reference should be had to the following detailed description and accompanying drawings wherein:

FIGS. 1A and 1B are respectively side perspective and front perspective views of a spray gun having a nozzle assembly connected thereto;

FIGS. 2A and 2B are respectively side perspective and front perspective views of the tool of the invention adapted for removing the nozzle assembly as shown in FIG. 1;

FIGS. 3A and 3B are illustrative views illustrating the utilization of the tool of the invention to remove or replace the spray nozzle assembly;

BEST MODE FOR CARRYING OUT THE INVENTION

Figure 4:
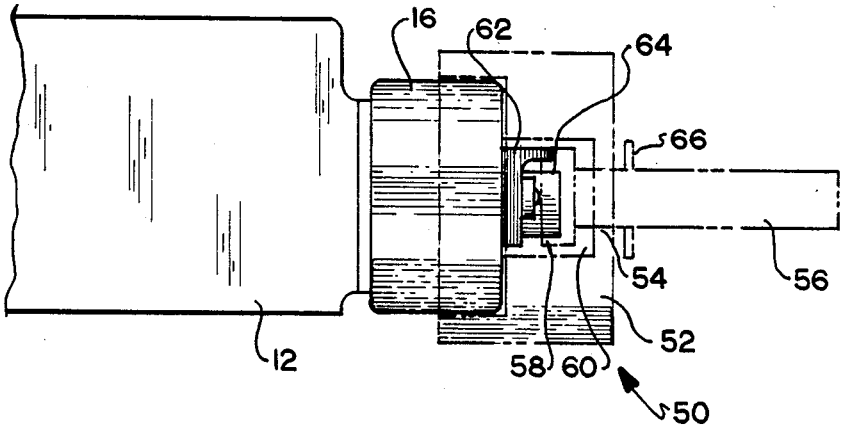
FIG. 4 is a side perspective view of a spray gun and nozzle assembly by a removal tool in accordance with a second embodiment of the invention.

Referring now to the drawings and more particularly FIG. 1, it can be seen that the front end of a spray gun assembly is designated generally by the numeral 10. For purposes of discussion herein, the gun assembly 10 may comprise either a handgun or an automatic gun. In either event, the body of the gun 12 has connected at a front end thereof a nozzle assembly 14. As is well known in the art, the nozzle assembly 14 would typically be screwed onto the body 12 as by threaded engagement to provide for ready changeability of nozzle assemblies. As further shown in FIGS. 1A and 1B, the nozzle assembly 14 includes a shell 16 having a scalloped periphery of alternating indentations 18 and protrusions 20. Such a design for the outer periphery of the shell is preferred, but it will be understood that various geometric configurations of the periphery may be suitable for the concept of the invention disclosed herein. Finally, an orifice assembly 22 is centrally located within the nozzle assembly 14, the orifice 22 achieving the atomization of the spray coating emitted from the gun assembly 10. Of course, the specific nature of the orifice assembly 22 will depend upon the type of coating to be sprayed.

With reference now to FIGS. 2A and 2B, the tool of the invention adapted for removing or applying the spray nozzle 14 to the gun 12 may be seen as designated by the numeral 30. As shown, the tool 30 comprises an outer casing 32, preferably knurled for enhancing the grip of the operator, giving better frictional contact between the casing and the operator's hands. An opening 34 forms a cavity within the outer casing 32 and, in the embodiment presented, has a scalloped periphery defined by alternating indentations 36 and protrusions 38 in an inner wall surface of the outer casing. It will be appreciated that the cavity 34 is closed at one end 40 thereof. The end 40 is typically of such a thickness that the total depth of the cavity formed by the opening 34 is greater than or equal to the depth of the shell 16 of the nozzle assembly 14. As illustrated, the scalloped periphery of the opening or cavity 34 is substantially congruent with the scalloped periphery of the shell 16, there being enough clearance between the two such that the shell 16 may be received within the cavity of the opening 34.

With reference now to to FIGS. 3A and 3B, it can be seen that the tool 30 is adapted to be placed over the nozzle assembly 14 threaded to the gun body 12. The knurled external surface of the tool 30 allows the operator to apply a torque to the tool for purposes of either applying or removing the nozzle assembly 14 with respect to the gun body 12. In FIG. 3A, the tool and nozzle assembly, coupled with the closed end 40 of the tool 30, totally protects the operator or user from the possibility of injection of coating material from the orifice assembly 22. This tight fitting relationship assures positive application or removal of the nozzle assembly with respect to the body of the gun 12 while protecting the operator from injection.

Yet another embodiment of a tool for removing and applying spray nozzles to coating guns may be seen in FIG. 4 as designated generally by the numeral 50. The tool includes an outer casing 52 which preferably is knurled to better accomodate the grip of the operator. The casing 52 is characterized by an opening 54 centrally through a top portion thereof, through which passes a locating rod 56. At one end of the locating rod 56 is a hub 58 which is received within a cavity 60 of the casing 52. The hub 58 is adapted to engage the guard 62 of the electrode 64, which guard and electrode are standard in spray nozzle assemblies. An alignment pin 66 passes through the locating rod 56 in registration with the guard 62 and electrode 64 when the hub 58 is in engagement with the guard 62. With the rod 56 being rotatable within the opening 54 of the outer casing 52, the operator may cause the hub 58 to engage the guard 62, appropriately position the electrode 64 by observation of the alignment pin 66, while securing the retaining ring 16 to the body of the gun 12. As discussed above, such secured engagement is achieved by rotation of the casing 52 in engagement with the scalloped shell of the retaining ring 16. While such secured engagement is made, the operator maintains the desired position of the electrode 64 by observation of the alignment or index pin 66.

Figure 5:
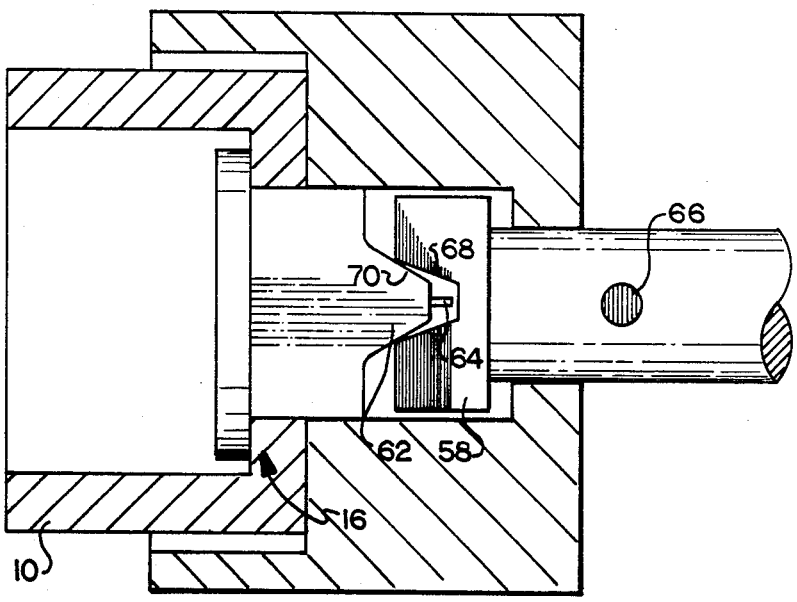
FIG. 5 is an illustrative sectional view of the embodiment of the invention of FIG. 4.

With reference to FIG. 5 is may be seen that the guard 62 is received by a notch in the hub 58, such notch being defined by the sloped walls 68. It will be noted that the walls 68 are of a steeper slope than the walls 70 of the guard 62. Accordingly, the walls 68,70 engage at a point wherein the electrode 64 is protected against the notch.

Thus it can be seen that the objects of the invention are satisfied by the structure that has been presented hereinabove. While in accordance with the patent statutes only the best mode and preferred embodiment of the invention has been presented and described in detail, the invention is not limited thereto or thereby. Accordingly, for an appreciation of the true scope and breadth of the invention, reference should be had to the following claims.

What is claimed is:

1. In a spray gun for use in spraying coating materials, the combination of a spray nozzle assembly and a tool for applying and removing the nozzle from the gun, comprising:

a spray nozzle shell;

a tool having an opening therein congruent with said shell, said opening being closed at one end thereof to define a cavity; and a rod passing through said one end of said tool, said rod having a hub thereon adapted for aligning engagement with an electrode of the spray nozzle assembly.

2. The combination according to claim 1, wherein said shell has a scalloped outer periphery.

3. The combination according to claim 2, wherein said opening has a scalloped periphery.

4. The combination according to claim 3, wherein said tool has a knurled outer periphery.

5. The combination according to claim 4, wherein said cavity is of a depth equal to or greater than the depth of said shell.

6. The combination according to claim 1, wherein said rod has a pin extending radially therefrom.

7. The combination according to claim 6, wherein said hub has a notch for receiving therein a quard for the electrode.

8. A tool for removing and replacing a spray nozzle of a spray coating gun, comprising:

a casing;

a cavity within said casing defined by an inner wall surface, said inner wall surface being of a configuration to receive, in selected alignment, an outer surface of the spray nozzle, said cavity being closed at one end thereof; and a rod passing through said one end, said rod having means at an end thereof for securing an electrode of the spray nozzle.

9. The tool according to claim 8, wherein said configuration of said inner wall surface is congruent with the outer surface of the spray nozzle.

10. The tool according to claim 9, wherein said casing has a fixed length and said cavity has a depth greater than the length of said casing, said cavity being adapted for totally receiving said casing.

11. The tool according to claim 8, wherein said means for securing comprises a hub having a notch therein, said notch defined by sloping walls adapted to engage a guard for the electrode.

12. The tool according to claim 11, wherein said rod further includes means in alignment with said slot for positioning the electrode to a desired alignment, said rod being movable within said cavity.

* * * * *